United States Patent [19]

Bargigia et al.

[11] Patent Number: 4,491,531

[45] Date of Patent: Jan. 1, 1985

[54] COMPOSITION BASED ON A FLUOROHYDROCARBON SOLVENT, SUITABLE FOR REMOVING WATER FROM THE SURFACE OF MANUFACTURED ARTICLES

[75] Inventors: Gianangelo Bargiga, Giuliano Carniselli, both of Milan, Italy

[73] Assignee: Montedison S.p.A. Milan, Italy

[21] Appl. No.: 422,146

[22] Filed: Sep. 23, 1982

[30] Foreign Application Priority Data

Sep. 25, 1981 [IT] Italy ..... 24153 A/81

[51] Int. Cl.[3] ..... C11D 7/50; C23G 5/02

[52] U.S. Cl. ..... 252/153; 252/171; 252/174.16; 252/545; 134/40

[58] Field of Search ..... 252/545, 153, 171, 174.16, 252/543; 134/40

[56] References Cited

U.S. PATENT DOCUMENTS

| | | | |
|---|---|---|---|
| 3,397,150 | 8/1968 | Burt et al | 252/153 |
| 3,903,009 | 9/1975 | Bauer et al. | 252/175 X |
| 3,903,012 | 9/1975 | Brandreth | 252/194 |
| 4,124,517 | 11/1978 | Hisamoto et al. | 252/153 X |
| 4,303,558 | 12/1981 | Hey | 252/153 X |

FOREIGN PATENT DOCUMENTS

| | | |
|---|---|---|
| 1285509 | 8/1972 | United Kingdom . |
| 1428530 | 3/1976 | United Kingdom . |
| 2036065 | 6/1980 | United Kingdom . |

*Primary Examiner*—John E. Kittle
*Assistant Examiner*—Mukund J. Shah

[57] ABSTRACT

A liquid composition based on a fluorinated hydrocarbon solvent, additioned with an amount not exceeding 0.5% by weight of a surfactant consisting of a salt of an aliphatic diamine and of an alkyl-mono- or di-ester of phosphoric acid, such composition being particularly suited to remove water from the surfaces of articles.

10 Claims, No Drawings

COMPOSITION BASED ON A FLUOROHYDROCARBON SOLVENT, SUITABLE FOR REMOVING WATER FROM THE SURFACE OF MANUFACTURED ARTICLES

BACKGROUND OF THE INVENTION

In various industrial fields there is frequently the necessity of drying the surfaces of finished pieces which in the preceding machining steps, due to different reasons, had been immerged in water.

It often happens too that, besides the removal of water, there is also the need to remove powders (such as residual abrasive powders) or deposits of machining scraps not thoroughly removed previously. The reasons which impose such necessity may be of merely aesthetical nature, such as in the field of goldsmith's wares, silver wares, spectacles and in the galvanic field.

In some cases, however, deposits of any kind which are not removed can adversely affect the performances of finished pieces, such as in the case of the electric, electronic, nuclear industry, as well as in the high-precision mechanical industry. In these cases, the machining scraps, the water, the natural salts contained in the water, the salts solubilized by water during the preceding treatments, may adhere, also in the form of microparticles, to the pieces and penetrate into inaccessible areas and they are removable only by means of techniques comprising the use of solvents having a relatively high density and being properly additioned.

The presence of all such foreign matters could cause short circuits, corrosions, decompositions to corrosive products, or could accelerate corrosion or abrasion phenomena or in any case in some way alter the calibration characteristics of high-precision proportioning valves, of electronic cards, of printed circuits which, as is known, are more and more often calibrated with the highest accuracy by employing the laser technology.

The problem of drying has already been differently envisaged.

British Pat. No. 1,285,509, for example, described the use of water-immiscible solvents additioned with salts obtained from unsaturated aliphatic carboxylic acids and diamines in which one of the two nitrogen atoms is substituted by an alkyl or by an alkylene. Another patent, French Pat. No. 2,217,045, claims the use of a composition consisting of a fluorine-containing solvent, with a solubility parameter, as is defined in J. Appl. Chem. 3, 71 (1953), lower than 8, and of a surfactant: the mixture is characterized in that the $H_2O$/solvent-interface tension does not exceed 6 dynes/cm and in that the employed surfactant has a water solubilization coefficient, measured in $CCLF_2—CCL_2F$, lower than 750 ppm.

A third patent, G.B. Pat. No. 1,428,530, besides claiming, as surfactants, diamides of unsaturated carboxylic acids and N-monosubstituted diamines, describes a machine suitable for such type of washing and of drying. It essentially consists of a tank in which the wet pieces are immersed: the removed water forms little drops which quickly collect on the surface, float on the organic solvent and are easily separated by decantation. The pieces are then rinsed with a pure solvent to remove the surfactant still present on the surfaces.

From an examination of the above-cited patents it appears that, in order to have satisfactory performances, at least 0.1% of surfactant is required. Such amount is relatively high and it would be desirable to find compositions in which the amount of additive is sensibly lower.

This would result in two main advantages:

(1) a reduction in the surfactant amount which, during the drying step, adheres to the washed pieces: this would facilitate the rinsing step in the pure solvent and would reduce the yet small amount of residual surfactant, thus ensuring a higher quality of the treated article;

(2) a reduction of the environmental pollution caused by possible dispersions of surfactants in the wastes.

THE PRESENT INVENTION

The new solvent compositions for the drying of articles according to the present invention are composed by:

(A) one or more fluorinated or chlorofluorinated hydrocarbons having a density equal to or higher than 1.3 g/ml at 20° C. and a boiling point ranging from 27° to 70° C., used either alone or in admixture with one another or admixed to minor amount of aliphatic alcohols having 1 to 4 carbon atoms or to azeotropic compositions of methylene chloride with said fluorinated compounds;

(B) from 0.0001 to 0.5% by weight, calculated on the dissolving mixture, and preferably from 0.0005 to 0.08%, of a surfactant characterized in that it is a salt formed by:

(I) one or more diamines of general formula:

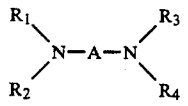

wherein $R_1$, $R_2$, $R_3$, $R_4$, either like or unlike one another, may be H, alkyls containing 1 to 6 carbon atoms, ethoxylated alkyls having 1 to 6 carbon atoms and 1 to 3 ethoxylic groups in the chain and where A is a linear or ramified alkylene $C_nH_{2n}$ containing from 4 to 20 carbon atoms, and (II) a monoester or a diester of phosphoric acid and mixtures thereof of general formula:

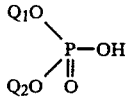

wherein $Q_1$ is a linear or ramified alkyl containing 6 to 20 carbon atoms or an ethoxylated alkyl containing, in the chain, from 6 to 26 carbon atoms and from 1 to 4 oxygen atoms in the aggregate and wherein $Q_2$ is equal to $Q_1$ or is hydrogen. In particular, $Q_1$ may be the radical 3,6-dioxapentadecyl ($C_9H_{19}—O—CH_2CH_2—O—CH_2CH_2)—$.

The ratio between the ester and the amine, in moles, ranges from 1:1 to 2:1.

Some examples of solvents are:

| | |
|---|---|
| 1,1,2-trichlorotrifluoroethane | b.p. 47.6° C. |
| 1,2-dichloro-1,1-difluoroethane | b.p. 46.8° C. |
| 1,1-dichloro-2,2,2-trifluoroethane | b.p. 27.1° C. |

Some examples of mixtures of solvents are:

94% by weight of 1,1,2 -trichlorotrifluoroethane and 6% of methanol

98% by weight of 1,1,2-trichlorotrifluoroethane and 2% of methanol

97% by weight of 1,1,2-trichlorotrifluoroethane and 3% of isopropanol

95% by weight of 1,1-dichloro-2,2,2-trifluoroethane and 5% of methanol

99% by weight of 1,2-dichloro-1,1-difluoroethane and 1% of ethanol

95% by weight of 1,1,2-trichlorotrifluoroethane and 5% of methylene chloride.

Some examples of surface-active agents are:

(1) 1,12-dodecandiammonium-bis-(decylphosphate)

(2) 1,12-dodecandiammonium-bis-(didodecylphosphate)

(3) 1,6-hexandiammonium-bis-[(2-ethyl)-hexylphosphate]

(4) 1,6-hexandiammonium-bis-[di-(2-ethyl)-hexylphosphate]

(5) 1,12-dodecandiammonium-bis-[di-(3,6-dioxapentadecyl)-phosphate]

(6) 1,4-butandiammonium-bis-[di-(3,6-dioxapentadecyl)-phosphate]

(7) 1-amino dodecyl-12-ammonium didecylphosphate (8) 1-amino dodecyl-12-ammonium didodecylphosphate (9) 1-amino dodecyl-12-ammonium di-(3,6-dioxapentadecyl)-phosphate

(10) 1-amino hexyl-6-ammonium didodecylphosphate.

The drying compositions composed by 1,1,2-trichlorotrifluoroethane or by 1,1,2-trichlorotrifluoroethane-methanol in the weight ratio of 94 to 6 and containing from 0.0005 to 0.08% of one of the surfactants specified hereinbelow have proved particularly useful:

1,12-dodecandiammonium-bis-[di-(3,6-dioxapentadecyl)-phosphate]

1-aminododecyl-12-ammonium-didodecylphosphate.

The compositions according to the present invention are very effective and, at the same time, do not undergo adverse alterations caused by coadjuvant additives, if any, such as, for example, derivatives of N, N, N', N'-tetracis-(2-hydroxypropyl)ethylendiamine, which are sometimes utilized by those skilled in the art and which are usually not employed as only additives of the chlorofluorinated solvents as they promote the forming of $H_2O$/solvent emulsions which require too long demixing times not compatible with the washing process or cause losses of solvents and of surface-active agent in case of insufficient time for demixing.

The compositions according to the present invention lower the interface tension of water/solvent to very low values, down to values below 1 dyne/cm even if used in very reduced concentrations and, as is known, this magnitude is in relation with the drying power of the composition.

Actually, the drying power of the mixtures conforming to this invention proves to be excellent on the basis of the results obtained both from drying tests of bodies capillary soaked with water and from surface drying tests in machines purposely constructed to this aim.

Furthermore, the effectiveness of these compositions is long-lasting: in fact the coefficient of distribution of the additive among organic solvent/water-phases is very high, thus making almost useless the replenishing of the additive, as is conversely required when the additive gets lost along with the water entrained by the pieces and continuously removed by decantation.

At the same time, the compositions according to the present invention, though retaining the water owing to the forming of thermodynamically stable microemulsions, contain moderate amounts of water, not higher than 600 ppm, what aids in ensuring the quality of the pieces undergoing the drying treatment.

The following examples are given to illustrate the characteristics of use of the compositions according to this invention and the results obtainable by employing same in drying processes. The phosphoric diesters used in the examples were prepared from $POCl_3$ according to John Van Wazer in "Phosphorous and its compounds" Interscience New York (1961) vol. 2 chap. 19 page 1221 and turn out to contain also a minor amount of mono-ester.

EXAMPLES 1 to 8

Into a 500 ml separatory funnel there were introduced 100 ml of the solvent reported in Table 1 as well as the indicated surfactant which has been dissolved in the specified amount. After addition of 100 ml of distilled water and after shaking for 10 minutes, the phases were allowed to decant. 40 ml of each phase were drawn and were introduced into a proper cylindrical vessel where they were allowed to stand for 30 minutes.

By means of a Nouy tensiometer, Mod. Cenco, equipped with a platinum ring having a circumference of 5.992 cm, the water/solvent-interface tension was determined four times. The average value is reported in Table 1 and compared with the one of the additive-free 1,1,2-trichlorotrifluoroethane.

TABLE 1

| Example No. | Solvent | Surfactant | Conc. % b.w. | Interface tension dyne/cm |
|---|---|---|---|---|
| Check | 1,1,2-trichloro-trifluoroethane | absent | — | 47 |
| 1 | 1,1,2-trichloro-trifluoroethane | 1,12-dodecandiammonium-bis-(didodecylphosphate) | 0.002 | 2 |
| 2 | 1,1,2-trichloro-trifluoroethane | 1-aminododecyl-12-ammonium-didodecylphosphate | 0.004 | 3 |
| 3 | 1,1,2-trichloro-trifluoroethane | 1-12-dodecandiammonium-bis-[di-(3,6-dioxapentadecyl)-phosphate] | 0.004 | <1 |
| 4 | 1,1,2-trichloro-trifluoroethane | 1-12-dodecandiammonium-bis-[di-(3,6-dioxapentadecyl)-phosphate] | 0.002 | <1 |
| 5 | 1,1,2-trichloro-trifluoroethan | 1-12-dodecandiammonium-bis-[di-(3,6-diozapentadecyl)-phosphate] | 0.001 | <<3 |
| 6 | 1-trichlorotri-fluoroethane 94% methanol 6% | 1-12-dodecandiammonium-bis-[di-(3,6-dioxapentadecyl)-phosphate] | 0.05 | 1 |
| 7 | 1-trichlorotri- | 1-12-dodecandiammonium-bis- | | |

TABLE 1-continued

| Example No. | Solvent | Surfactant | Conc. % b.w. | Interface tension dyne/cm |
|---|---|---|---|---|
| | fluoroethane 94% methanol 6% | [di-(3,6-dioxapentadecyl)-phosphate] | 0.01 | <1 |
| 8 | 1-trichlorotri-fluoroethane 94% methanol 6% | 1-12-dodecandiammonium-bis-[di-(3,6-dioxapentadecyl)-phosphate] | 0.001 | 3 |

EXAMPLES 9 to 16

It was operated as in examples 1 to 8. After having shaken for 10 minutes the solvent+surfactant composition with distilled water and having waited for a sharp separation of the phases, 25 ml of organic solution were drawn and, by means of a Metrohm Herisau apparatus for the determination of water according to K. Fischer, the water content was measured.

The values obtained are recorded on Table 2.

EXAMPLE 17

Into a 500 ml separatory funnel there were introduced 100 ml of 1,1,2-trichlorotrifluoroethane and the same surfactant as described in example 1 and at the same concentration. By operating as illustrated in example 1, except that water having a hardness of 33 French degrees was used instead of distilled water, a water/solvent - interface tension of 3 dynes/cm was determined.

TABLE 2

| Example No. | Solvent | Surfactant | Conc. % b.w. | Soluble $H_2O$ ppm |
|---|---|---|---|---|
| Check | 1,1,2-trichloro-trifluoroethane | absent | — | 55 |
| 9 | 1,1,2-trichloro-trifluoroethane | 1,12-dodecandiammonium-bis-(didodecylphosphate) | 0.002 | 75 |
| 10 | 1,1,2-trichloro-trifluoroethane | 1-aminododecyl-12-ammonium didodecylphosphate | 0.004 | 137 |
| 11 | 1,1,2-trichloro-trifluoroethane | 1,12-dodecandiammonium-bis-[di-(3,6-dioxapentadecyl)phosphate] | 0.004 | 258 |
| 12 | 1,1,2-trichloro-trifluoroethane | 1,12-dodecandiammonium-bis-[di-(3,6-dioxapentadecyl)phosphate] | 0.002 | 150 |
| 13 | 1,1,2-trichloro-trifluoroethane | 1,12-dodecandiammonium-bis-[di-(3,6-dioxapentadecyl)phosphate] | 0.001 | 95 |
| 14 | 1,1,2-trichloro-trifluoroethane 94% methanol 6% | 1,12-dodecandiammonium-bis-[di-(3,6-dioxapentadecyl)phosphate] | 0.05 | 260 |
| 15 | 1,1,2-trichloro-trifluoroethane 94% methanol 6% | 1,12-dodecandiammonium-bis-[di-(3,6-dioxapentadecyl)phosphate] | 0.01 | 172 |
| 16 | 1,1,2-trichloro-trifluoroethane 94% methanol | 1,12-dodecandiammonium-bis-[di-(3,6-dioxapentadecyl)phosphate] 6% | 0.001 | 80 |

EXAMPLE 18

350 ml of 1,1,2-trichlorotrifluoroethane additioned with 0.025 g of 1,12-dodecandiammonium-bis-[di-(3,6-dioxamentadecyl)phosphate] and 350 ml of distilled water were introduced into a 1000 ml separatory funnel.

After having shaken for a long time and waited for the separation of the phases, 40 ml of each phase were drawn and the interface tension was measured, which resulted to be 1 dyne/cm.

The organic phase and the aqueous phase were completely separated, and the residual organic phase as well as 310 ml of fresh distilled water were introduced into the same separatory funnel.

Shaking was repeated and 40 ml of each phase were drawn again: an interface tension of 1 dyne/cm was determined. The same operation was repeated with always fresh water for further three times: the interface tensions resulted in all cases to be lower than 1 dyne/cm.

EXAMPLE 19

In a laboratory membrane filter Sartorius, mod. SM 16315, having a capacity of 35 ml and an inside diameter of 20 mm, instead of a filtering membrane, a small disc of like diameter and 2 mm thick, cut by means of a hollow punch from a synthetic sponge for domestic uses, trademark Wettex, was clamped between the flanges.

The disc was soaked with 1 ml of water; 20 ml of 1,1,2-trichlorotrifluoroethane additioned with 0.004% by weight of 1,12-dodecandiammonium-bis-[di-(3,6-dioxapentadecyl)-phosphate] were made to flow and were collected in a 50 ml flask.

The solvent so collected was exactly diluted to 50 ml with anhydrous methanol and the water content was determined, according to the K. Fischer method, on a 2 ml portion. The removed water corresponded to 0.440 g. The value indicated hereinabove was compared at first with the value obtained by using 1,1,2-trichlorotrifluoroethane free from additives: the removed water amount was of 0.120 g; a second comparison carried out by using 1,1,2-trichlorotrifluoroethane containing 0.01% of hexylammonium didodecylphosphate indicated that 0.275 g of water was removed.

EXAMPLE 20

3.7 l of 1,1,2-trichlorotrifluoroethane containing 0.22 g of 1,12-dodecandiammonium-bis-[di-(3,6-dioxapentadecyl)phosphate] were introduced into an ultrasound equipment for the washing of small laboratory implements, trademark Sonicor, having a capacity of 4.7 l.

After heating of the solvent to boiling, No. 10 microscope slides 76×26 mm, not previously degreased and wetted with running water, supported on a plexiglass frame, were introduced.

The slides were taken out perfectly dry after 15 seconds.

For comparative purposes, the test was repeated using 1,1,2-trichlorotrifluoroethane free from additives. After 15 seconds the slides resulted to be still remarkably wet and after further 70 seconds they were still partially wet. For a further comparison, the above treatment was repeated using a solution of 0.20 g of n-propylammonium-didodecyl phosphate in 3.5 l of 1,1,2-trichlorotrifluoroethane. After 15 seconds the slides appeared still remarkably wet, after further 45 seconds drying was still partial.

EXAMPLE 21

Into the same equipment as described in example 20 there were introduced 3.7 l of 1,1,2-trichlorotrifluoroethane containing 0.22 g of 1,12-dodecandiammonium-bis-[di-(3,6-dioxapentadecyl)phosphate]; after having heated the solvent to boiling, there were introduced, after wetting in running water, the articles listed hereinbelow:

(1) stainless steel knives,
(2) cellulose acetate spectacles complete with glass lenses,
(3) electronic components,
(4) a printed-circuit electronic card, 70×130 mm, useful as amplifier for temperature recorders, including: 1 diode, 1 potentiometer, 3 electrolytic condensers, 4 polyester condensers, 5 carbon resistances, 1 wire resistance and 2 valve bases.

After a 15 second immersion, articles No. 1, 2, 3 were thoroughly dry, while articles No. 4 exhibited a few microdrops in the introduction points of the components in the card.

By way of comparison, the same test was repeated using n-propylammonium didodecylphosphate as an additive: it was observed that all the considered articles and in particular article No. 4 were still quite wet after 15 seconds.

EXAMPLE 22

Into the same apparatus described in example 20 there were charged 3.7 l of 1,1,2-trichlorotrifluoroethane containing 0.22 g of 1,12-dodecandiammonium-bis-[di-(3,6-dioxapentadecyl)phosphate] and, after having heated the liquid to boiling, there was introduced, after having been wetted in running water, heating unit CVD of mass spectrometer Varian MAT/CH7.

After 2 minutes the unit was drawn from the bath and introduced again into the mass spectrometer.

After such operation, the mass spectrometer was regularly running without any defaults.

What we claim is:

1. A homogeneous solvent composition, suitable for removing water from wet articles, comprising:

(a) one or more fluorinated or chlorofluorinated hydrocarbons having a density of at least 1.3 g/ml at 20° C., a boiling point in the range of from 27° to 70° C., optionally in admixture with $CH_2Cl_2$;

(b) from 0.0001 to 0.5% by weight, referred to the dissolving mixture, of a surface-active agent consisting of a salt formed by:

(I) one or more diamines of general formula $$H_2N—A—NH_2$$

wherein A is a linear or ramified alkylene $C_nH_{2n}$ containing 4 to 20 carbon atoms, and (II) a monoester or a diester of phosphoric acid and mixtures thereof, of general formula:

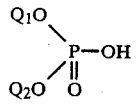

wherein $Q_1$ is a linear or ramified alkyl containing from 6 to 20 carbon atoms, or an ethoxylated alkyl having in the chain 6 to 26 carbon atoms and 1 to 4 oxygen atoms in the aggregate, and wherein $Q_2$ is equal to $Q_1$ or is hydrogen, the molar ratio between ester and amine in said salt being in the range of from 1:1 to 2:1.

2. The solvent composition according to claim 1, in which the fluorinated hydrocarbon is 1,1,2-trifluorotrichloroethane.

3. The solvent composition according to claim 1 or 2, in which the surface-active agent is contained in amounts of from 0.0005 to 0.08% by weight.

4. The composition according to claim 1, in which the surface active agent is 1,12-dodecandiammonium-bis-[di-(3,6-dioxapentadecyl) phosphate].

5. The composition according to claim 1, in which the surface-active agent is 1,12-dodecandiammonium-bis-(didodecylphosphate).

6. The composition according to claim 1, in which the surface-active agent is 1-amino-dodecyl-12-ammonium didodecylphosphate.

7. The composition according to claim 1 in which the surface active agent is 1,12-dodecandiammonium-bis-(dodecylphosphate).

8. The composition according to claim 1 in which the surface active agent is 1,12-dodecandiammonium-bis-(3,6-dioxapentadecylphosphate).

9. The composition according to claim 1 in which the surface active agent is a mixture of the surface active agent of claims 5 and 7.

10. The composition according to claim 1 in which the surface active agent is a mixture of the surface active agents of claims 4 and 8.

* * * * *